US008181695B2

(12) United States Patent
Bradu et al.

(10) Patent No.: US 8,181,695 B2
(45) Date of Patent: May 22, 2012

(54) REINFORCEMENT FOR DISH PLATE HEAT EXCHANGERS

(75) Inventors: Pascal Bradu, Compiegne (FR); Xiaoyang Rong, Toronto (CA); Thomas Chan, Oakville (CA)

(73) Assignee: Dana Canada Corporation, Oakville, Ontario (CA)

( * ) Notice: Subject to any disclaimer, the term of this patent is extended or adjusted under 35 U.S.C. 154(b) by 1338 days.

(21) Appl. No.: 11/538,919

(22) Filed: Oct. 5, 2006

(65) Prior Publication Data

US 2007/0084809 A1 Apr. 19, 2007

Related U.S. Application Data

(60) Provisional application No. 60/723,755, filed on Oct. 5, 2005.

(51) Int. Cl.
*F28F 3/00* (2006.01)
*F28F 3/08* (2006.01)

(52) U.S. Cl. ..... 165/166; 165/167; 165/906; 165/916

(58) Field of Classification Search ..... 165/906, 165/916, 166, 167
See application file for complete search history.

(56) References Cited

U.S. PATENT DOCUMENTS

| | | | | |
|---|---|---|---|---|
| 4,708,199 | A | 11/1987 | Yogo et al. | |
| 4,892,136 | A | 1/1990 | Ichihara et al. | |
| 4,987,955 | A | 1/1991 | Bergqvist et al. | |
| 5,099,912 | A | 3/1992 | Tajima et al. | |
| 5,462,113 | A | 10/1995 | Wand | |
| 5,464,056 | A | 11/1995 | Tajima et al. | |
| 5,511,612 | A | 4/1996 | Tajima et al. | |
| 5,810,071 | A | 9/1998 | Pavlin | |
| 5,927,394 | A | 7/1999 | Mendler et al. | |
| 5,988,269 | A | 11/1999 | Karlsson et al. | |
| 6,546,996 | B2 | 4/2003 | Hudson et al. | |
| 6,843,311 | B2 * | 1/2005 | Evans et al. | 165/167 |
| 7,533,717 | B2 * | 5/2009 | Hummel et al. | 165/167 |
| 2003/0159805 | A1 | 8/2003 | Muhammad et al. | |
| 2003/0201094 | A1 * | 10/2003 | Evans et al. | 165/109.1 |
| 2004/0040697 | A1 | 3/2004 | Pierre et al. | |

(Continued)

FOREIGN PATENT DOCUMENTS

| | | | |
|---|---|---|---|
| CA | 2383649 | A1 | 10/2003 |

(Continued)

OTHER PUBLICATIONS

International Search Report and Written Opinion issued in respect of corresponding International Application PCT/CA2006/001638.

*Primary Examiner* — Cheryl J Tyler
*Assistant Examiner* — Brandon M Rosati
(74) *Attorney, Agent, or Firm* — Ridout & Maybee LLP

(57) ABSTRACT

A reinforcing element for a heat exchanger of the type having nested dish plates with inclined, peripheral, overlapping walls, where at least one of the nested dish plates is attached to a mounting plate, the mounting plate extending beyond the outer periphery of the walls of the nested dish plates. The reinforcing element has a base flange attached to the mounting plate extending beyond the outer periphery of the walls of the nested dish plates. The reinforcing element also has a peripheral flange located in parallel, overlapping engagement with the inclined peripheral wall of the at least one dish plate attached to the mounting plate.

13 Claims, 4 Drawing Sheets

U.S. PATENT DOCUMENTS

| | | | | |
|---|---|---|---|---|
| 2004/0112579 | A1 | 6/2004 | Strahle | |
| 2005/0006544 | A1 | 1/2005 | Kaspar et al. | |
| 2005/0121182 | A1 * | 6/2005 | Hummel et al. | 165/167 |
| 2006/0032621 | A1 | 2/2006 | Martin et al. | |
| 2006/0081358 | A1 | 4/2006 | Pierre et al. | |
| 2007/0023175 | A1 * | 2/2007 | Richter | 165/167 |
| 2008/0257536 | A1 * | 10/2008 | Kolblin et al. | 165/167 |

FOREIGN PATENT DOCUMENTS

| | | | |
|---|---|---|---|
| DE | 19519740 | A1 | 12/1996 |
| DE | 19711258 | A1 | 9/1998 |
| EP | 0597778 | A1 | 5/1994 |
| EP | 0623798 | A2 | 11/1994 |
| EP | 1241428 | A2 | 9/2002 |
| JP | 02089991 | A2 | 3/1990 |
| JP | 03204596 | A2 | 9/1991 |
| JP | 03271697 | A2 | 12/1991 |
| JP | 2000213889 | A | 8/2000 |
| WO | WO 2005038377 | A1 * | 4/2005 |

* cited by examiner

REINFORCEMENT FOR DISH PLATE HEAT EXCHANGERS

FIELD OF THE INVENTION

This invention relates to heat exchangers, and in particular to heat exchangers formed of a plurality of stacked or nested dish-type plates with overlapping peripheral walls.

BACKGROUND OF THE INVENTION

Nested dish plate heat exchangers have been made in the past where a plurality of stacked plates having overlapping peripheral side walls are put together to define hollow fluid passages between the plates, usually with different fluids in heat exchange relationship in alternating spaces between the plates. Usually, a base plate or mounting plate is attached to an uppermost or a lowermost one of the stacked plates, and the mounting plate has holes or fasteners to attach the heat exchanger to a piece of equipment, such as an automobile engine. Oil from the engine passes through openings in the mounting plate and engine coolant passes through other inlet and outlet holes in the mounting plate, or fittings attached to the heat exchanger in order to cool the engine oil in use.

In the nested dish plate heat exchangers made in the past, the plates are usually made of thin material. Also, the plates are often made of aluminum which has inherently lower mechanical strength relative to ferrous alloys, particularly after brazing. A difficulty with this is that some of the dish plates, usually the ones attached to the mounting plate, are prone to fatigue fracture due to vibration, mounting plate deformation, thermal stresses and internal pressure stresses transmitted from the engine to the nested dish plates through the mounting plate, and also from the coolant hoses attached to the heat exchanger. Base plate or mounting plate deformation, in particular, presents a significant problem since mounting plates may tend to form poor braze joints with the lowermost plate in the stack of nested dish plates and are, therefore, prone to failure.

In U.S. Pat. No. 5,927,394 issued to Robert Mendler, et al., an attempt is made to ameliorate the difficulties mentioned above by adding an extra thick reinforcing dish plate below the lowermost regular dish plate. The reinforcing dish plate is formed with a generally flat base portion and has upright tabs formed on its longitudinal and transverse sides which are bent upwards at an angle from the plane of the base portion. A difficulty with this is that the extra reinforcing plate adds height and weight to the heat exchanger. The reinforcing plate also requires a unique and costly die, as well as increased care and handling during assembly and thus adds cost to its manufacture.

SUMMARY OF THE INVENTION

In the present invention, a reinforcing element surrounds at least a portion of a regular heat exchanger dish plate attached to the mounting plate. The reinforcing element has a base flange attached to the mounting plate, and a peripheral flange in parallel, overlapping contact with the inclined peripheral wall of the regular heat exchanger dish plate.

According to one aspect of the invention, there is provided a reinforcing element for a dish plate heat exchanger having a mounting plate and a plurality of nested dish plates mounted thereon, the dish plates having inclined peripheral, overlapping walls and the mounting plate extending beyond the outer periphery of the walls of the nested dish plates. The reinforcing element comprises a base flange adapted to be attached to the mounting plate extending beyond the outer periphery of the walls of the nested dish plates. Also, a peripheral flange is attached to the base flange. The peripheral flange is adapted to be in parallel, overlapping contact with the inclined peripheral wall of at least one dish plate attached to the mounting plate.

According to another aspect of the invention, there is provided a dish plate heat exchanger comprising a mounting plate and a plurality of nested dish plates mounted on the mounting plate. The dish plates have inclined, peripheral, overlapping walls, the mounting plate extending beyond the outer periphery of the walls of the nested dish plates. A reinforcing element has a base flange attached to the mounting plate extending beyond the outer periphery of the nested dish plates. Also, the reinforcing element has a peripheral flange attached to the base flange. The peripheral flange is attached in parallel, overlapping engagement with the inclined peripheral wall of at least one dish plate attached to the mounting plate.

According to a further aspect of the invention, there is provided a reinforcing element for a dish plate heat exchanger having a mounting plate and a plurality of nested dish plates mounted thereon, the dish plates having inclined, peripheral, overlapping walls, the mounting plate extending beyond the outer periphery of the walls of the nested dish plates. The reinforcing element comprises a base portion adapted to be positioned between the mounting plate and the plurality of nested dish plates. A peripheral flange is attached to the periphery of at least a portion of the base portion, the peripheral flange being adapted to be in parallel, overlapping contact with the inclined peripheral wall of at least one dish plate in the plurality of nested dish plates. The reinforcing element also includes a tongue portion extending outwardly from the base portion, the tongue portion being configured to overlap a high-stress area of the mounting plate extending beyond the outer periphery of the walls of the nested dish plates.

BRIEF DESCRIPTION OF THE DRAWINGS

Embodiments of the invention will now be described, by way of example, with reference to the accompanying drawings, in which.

DESCRIPTION OF THE PREFERRED EMBODIMENTS

Figure 1:
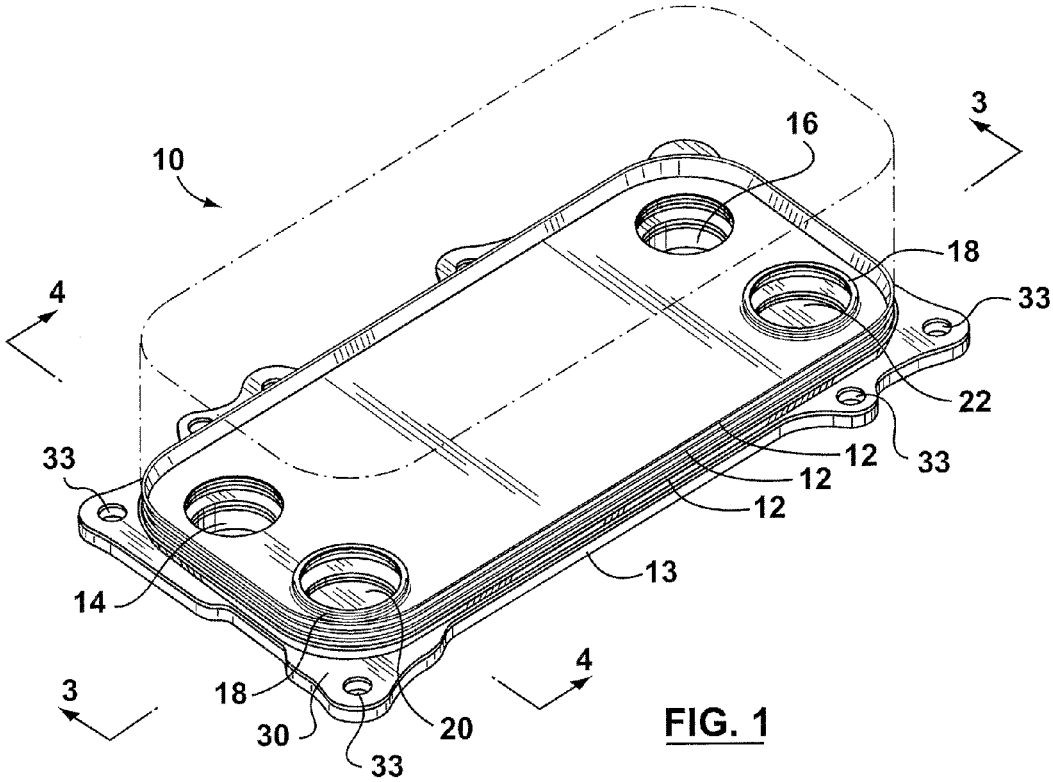
FIG. 1 is a perspective view of an embodiment of a nested dish heat exchanger according to the present invention.

Referring firstly to FIGS. 1 to 4, a nested dish type heat exchanger 10 is shown in FIG. 1. Only a few of the nested dish plates 12 are shown for illustration purposes, the remainder being represented by chain-dotted lines. The nested dish plates 12 are mounted on a mounting plate 13.

The nested dish plates 12 have bottom walls 15 defining inlet and outlet openings 14, 16 for a first heat exchange fluid, such as engine oil, and embossments or bosses 18 defining further inlet and outlet openings 20, 22 for a second heat exchanger fluid, such as engine coolant. Inlet and outlet fittings (not shown) are also provided for the supply and return of engine coolant to inlet and outlet openings 20, 22. However, mounting plate 13 could be provided with inlet and outlet openings (not shown) communicating with dish plate inlet and outlet openings 20, 22, if desired. Alternatively, mounting plate 13 could have one inlet opening communicating with dish plate inlet openings 20, and one outlet fitting (not shown) could be provided in heat exchanger 10 communicating with dish plate outlet openings 22.

The dish plates 12 are stacked with alternating plates turned 180 degrees to one another, so that inlet and outlet openings 14, 16 communicate with spaces or flow passages 24 between every other pair of adjacent plates. Similarly, inlet and outlet openings 20, 22 communicate with spaces or flow passages 26 in between every other alternating pair of adjacent plates. In other words, a first heat exchange fluid, such as engine oil, and a second heat exchange fluid, such as engine coolant, would flow through alternate flow passage 24, 26 in heat exchanger 10.

Figure 3:
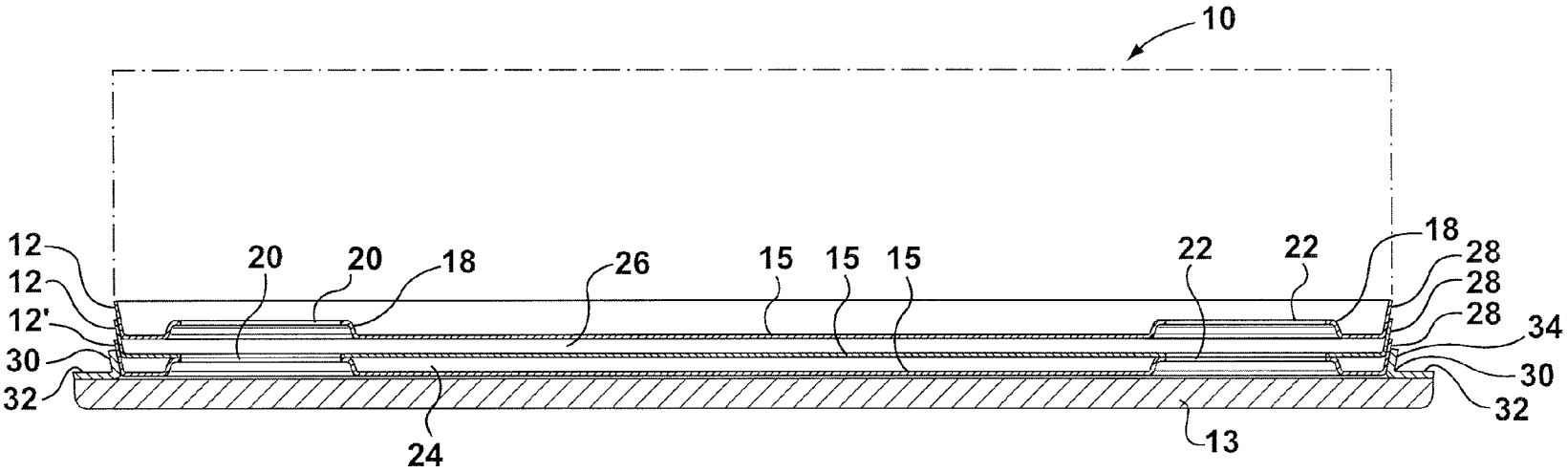
FIG. 3 is a cross-sectional view taken along lines 3-3 of FIG. 1.
Figure 4:
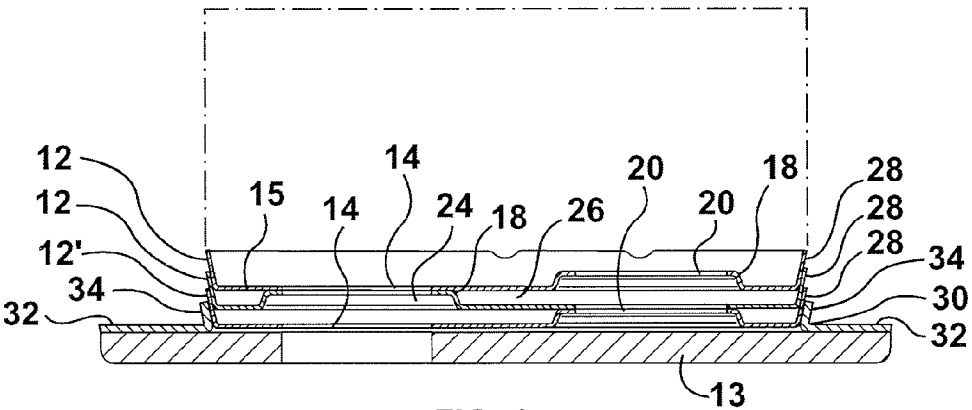
FIG. 4 is a cross-sectional view taken along lines 4-4 of FIG. 1.

As seen best in FIGS. 3 and 4, dish plates 12 have inclined, peripheral, overlapping side walls 28. Each peripheral wall 28 extends about, or just slightly more than, half way up the peripheral wall 28 next above it. This provides a double thickness sidewall for heat exchanger 10, except in the case of the lowermost dish plate 12'.

Figure 2:
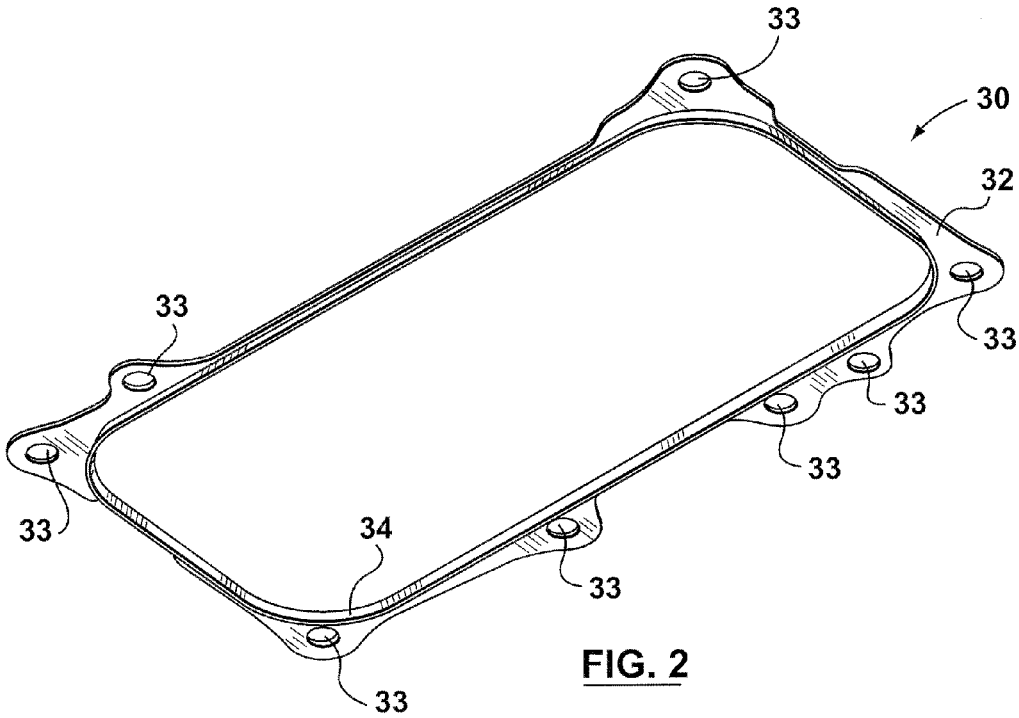
FIG. 2 is a perspective view of one embodiment of a reinforcing element according to the present invention for use with a dish plate heat exchanger.

Referring next, in particular to FIGS. 2 to 4, heat exchanger 10 includes a reinforcing element 30. Reinforcing element 30 includes a base flange 32 attached to mounting plate 13, such as by brazing. Base flange 32 may have a peripheral configuration to match mounting plate 13, in which case, base flange 32 would be provided with mounting holes 33 to match corresponding mounting holes in mounting plate 13. Reinforcing element 30 surrounds the nested dish plates 12. Reinforcing element 30 also has a peripheral flange 34 attached to base flange 32. Peripheral flange 34 is attached in parallel, overlapping engagement with the inclined peripheral wall 28 of the lowermost dish plate 12', which in turn is attached to mounting plate 13. Peripheral flange 34 could, with suitable modifications, overlap more than one peripheral wall 28 on multiple dish plates 12, but it at least overlaps the one peripheral wall 28 on the dish plate 12' attached to mounting plate 13. That way, heat exchanger 10 has a double side wall thickness throughout its entire height.

Figure 5:
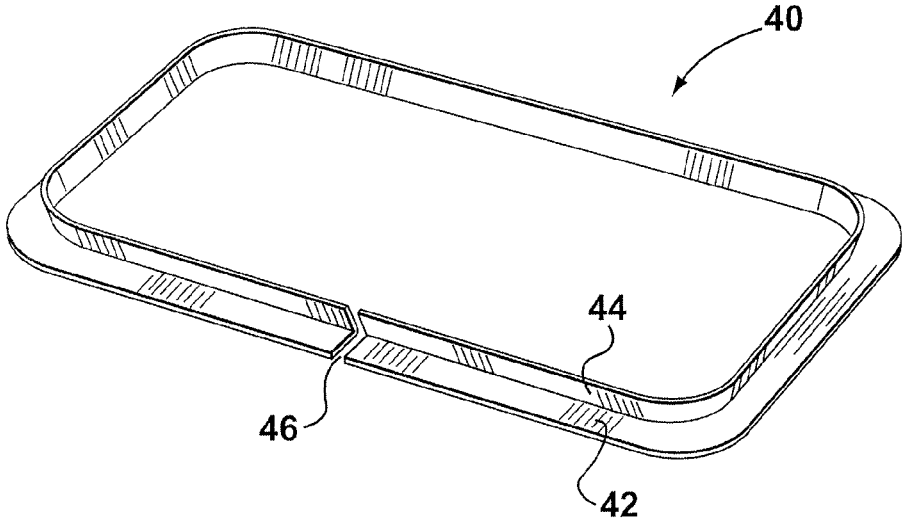
FIG. 5 is a perspective view of another embodiment of a reinforcing element according to the present invention.
Figure 6:
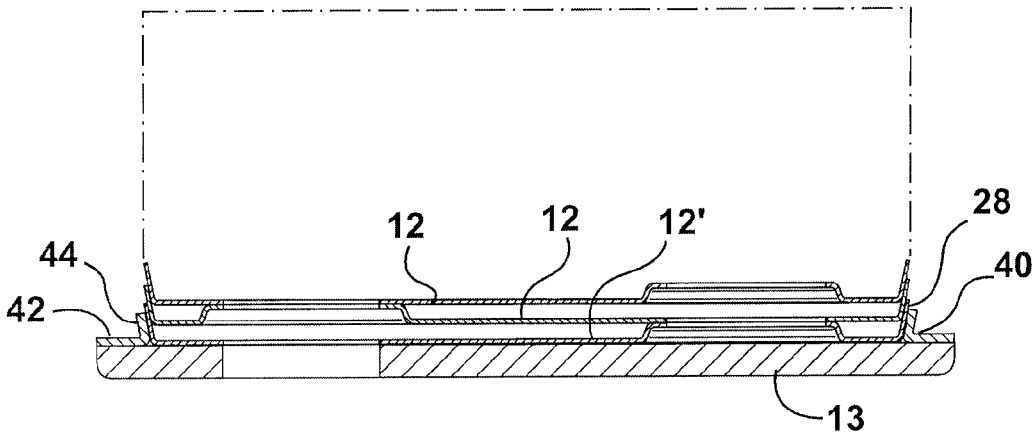
FIG. 6 is a cross-sectional view similar to FIG. 4 but employing the reinforcing element of FIG. 5.

Referring next to FIGS. 5 and 6, another embodiment of a reinforcing element 40 is shown, which could be used in place of the reinforcing element 30 shown in FIGS. 1 to 4. Reinforcing element 30 also has a base flange 42 which is attached to mounting plate 13 surrounding dish plates 12, and a peripheral flange 44 attached to base flange 42. Peripheral flange 44 is attached in parallel, overlapping engagement with the inclined peripheral wall 28 of the at least one dish plate 12' attached to mounting plate 13.

Reinforcing element 40 preferably is made by roll forming and is then bent into an annular configuration to surround dish plate 12. Reinforcing element 40 thus would have a small gap 46 (emphasized in FIG. 5 for the purposes of illustrations). Gap 46 could be closed or filled in or covered during assembly of heat exchanger 10, if desired. Gap 46 could also be made larger, if no reinforcement of heat exchanger 10 is needed in the area of the gap.

Figure 7:
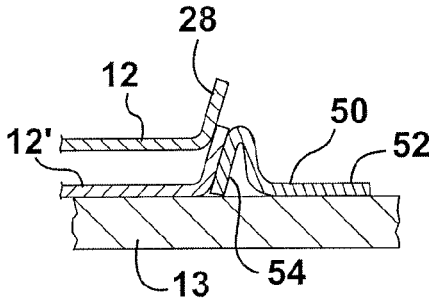
FIG. 7 is a scrap cross-sectional view of another embodiment of a reinforcing element according to the present invention.

FIG. 7 shows a variation that could be applied to any of the previously described reinforcing elements. In FIG. 7, reinforcing element 50 has a base flange 52 and an inverted peripheral flange 54, wherein the peripheral flange 54 is in the form of an inverted V-shape.

Figure 8:
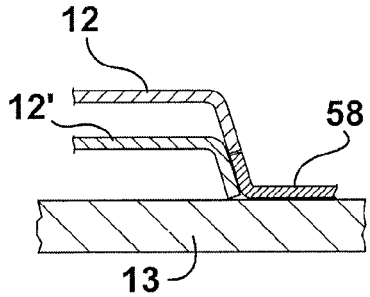
FIG. 8 is a scrap cross-sectional view similar to FIG. 7, but showing another embodiment of a nested dish plate heat exchanger according to the present invention.

FIG. 8 shows another variation of a nested dish plate heat exchanger where the dish plates 12 are inverted. Reinforcing element 58 could be the same as either of the reinforcing elements 30 or 40.

Figure 9:
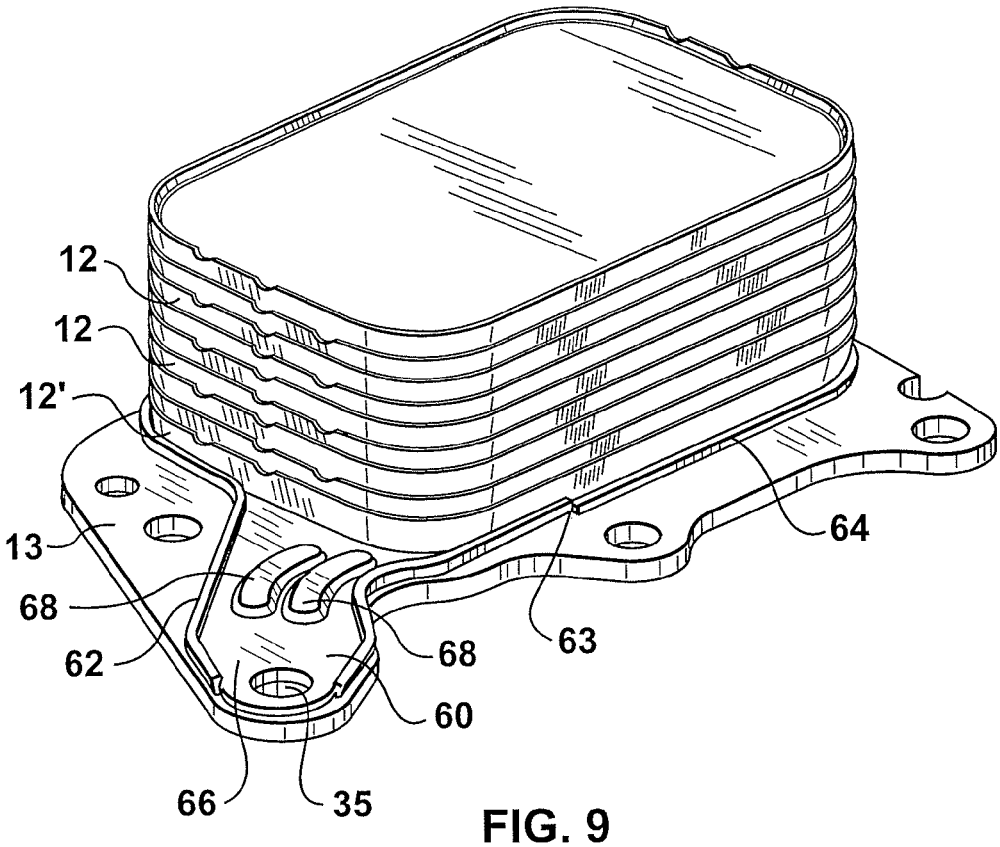
FIG. 9 is a perspective view of yet another embodiment of a reinforcing element in use with a nested dish heat exchanger according to the present invention.
Figure 10:
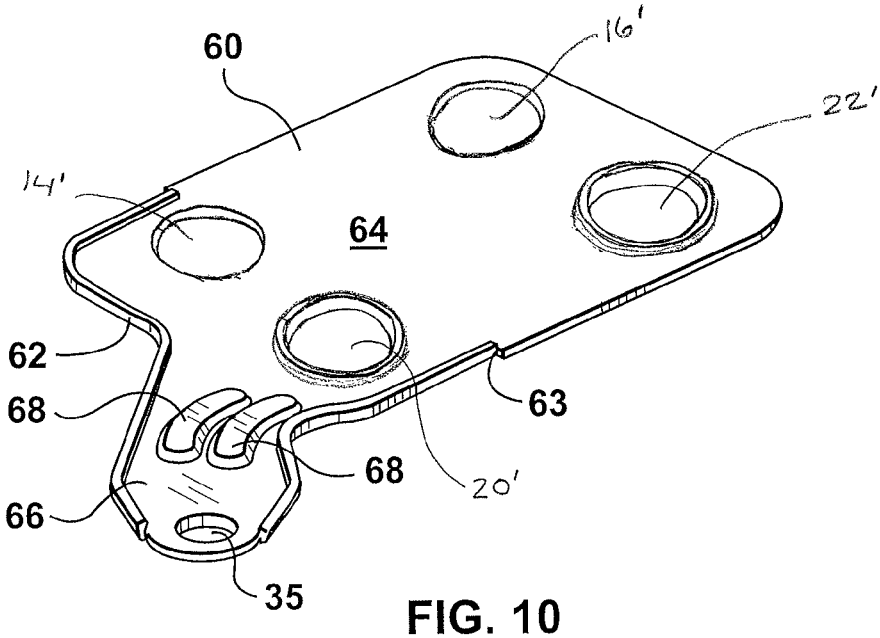
FIG. 10 is a perspective view of the reinforcing element of FIG. 9.

FIGS. 9 and 10 show another embodiment of a reinforcing element according to the present invention in use with a nested dish type heat exchanger as described in connection with FIGS. 1-8. Therefore, although not visible in FIG. 9, dish plates 12 include inlet and outlet openings for the flow of first and second heat exchange fluids through the heat exchanger as described in connection with FIG. 1. However, in this embodiment, reinforcing element 60 has a base portion 64 that is positioned between the stack of nested dish plates 12 and mounting plate 13 (see FIG. 10). Base portion 64 includes inlet and outlet openings 14', 16', 20', 22' corresponding to the openings in plates 12. In this embodiment, the reinforcing element 60 is provided with a peripheral flange 62 that does not completely surround the dish plate 12'. Rather, the peripheral flange 62 terminates at an end edge 63 along one of the sides of the nested dish plates which illustrates that the peripheral flange 63 does not need to continuously surround the dish plates 12 in all cases. The base 64 extends slightly beyond the periphery of the nested dish plates 12 in the areas where there is no peripheral flange 62. As mentioned above, while it is not necessary that the peripheral flange 62 completely surround the dish plates 12, it is preferable, that there be at least a portion of the peripheral flange 62 in the areas of high stress concentration, such as adjacent regions in the mounting plate exposed to engine oil at high pressure. Reinforcing element 60 is also formed with an extended portion or tongue portion 66 that extends from the base portion 64 of the reinforcing element 60 and is configured to overlap a portion of the mounting plate 13 that is subject to higher stresses. Peripheral flange 62 follows the periphery of at least a portion of tongue portion 66. In this embodiment, the tongue portion 66 is formed with a pair of reinforcing ribs 68 projecting upwardly from the surface of the tongue portion 66 to increase the rigidity of the tongue portion 66, thereby increasing the overall strength of the reinforcing member 60. The tongue portion 66 also provides additional reinforcement around mounting hole 35 which may also be subject to higher stresses due to flexing or deformation of the mounting plate 13 in this area.

While the reinforcing element shown in FIGS. 9 and 10 shows the tongue portion 66 extending from the base portion 64 that is positioned between the lowermost nested dish plate 12' and mounting plate 13, it will be understood that a similar tongue portion having reinforcing ribs and a peripheral flange can be incorporated into any one of the reinforcing elements shown in FIGS. 1-8 so as to provide additional strength in areas where the mounting plate 13 is subject to higher stress concentrations. When incorporated into the embodiments shown in FIGS. 1-8, the tongue portion would extend from a section of base flange 32, 42, or 52.

While the present invention has been described with reference to certain preferred embodiments, it will be understood by persons skilled in the art that the invention is not limited to these precise embodiments and that variations or modifications can be made without departing from the scope of the invention as described herein. For example, as described in connection with FIG. 5, gap 46 could be made larger if no reinforcement of heat exchanger 10 is needed in the area of the gap. In fact, the reinforcing element 40 could be made in smaller, individual segments that are positioned around the nested dish plates 12 at only high-stress areas rather than having the reinforcing element 40 surround the entire stack of nested dish plates 12. As well, in addition to using roll forming and bending techniques to form the reinforcing element, the reinforcing element 30, 40 can also be formed by stamping. Any suitable material may be used to form the reinforcing element; however it is possible to use one-sided clad braze sheet for most if not all of the embodiments discussed above.

The invention claimed is:

1. A reinforcing element for a dish plate heat exchanger, the heat exchanger having a mounting plate and a plurality of nested dish plates mounted thereon, the dish plates having inclined, peripheral, overlapping walls, the mounting plate being positioned underneath and extending beyond the outer periphery of the walls of the nested dish plates, wherein the reinforcing element comprises:

an outwardly extending base flange adapted to be attached to at least a portion of the mounting plate that extends beyond the outer periphery of the walls of the nested dish plates, the base flange adapted to be positioned on the mounting plate proximal to and also adapted to generally surround a lowermost one of the plurality of nested dish plates; and a peripheral flange extending generally upwardly from the base flange, the peripheral flange being adapted to be in parallel, overlapping contact with the inclined peripheral wall of at least the lowermost dish plate attached to the mounting plate, and wherein the reinforcing element having an opening permitting a bottom wall of the lowermost dish plate to directly contact the mounting plate.

2. A reinforcing element as claimed in claim 1, wherein the base flange has a peripheral configuration adapted to correspond to at least a portion of the mounting plate extending beyond the outer periphery of the walls of the nested dish plates.

3. A reinforcing element as claimed in claim 2, wherein the base flange has mounting holes formed therein corresponding to mounting holes formed in the mounting plate.

4. A reinforcing element as claimed in claim 1, wherein the base flange and the peripheral flange are adapted to completely surround at least the lowermost dish plate attached to the mounting plate.

5. A reinforcing element as claimed in claim 1, wherein the base flange and peripheral flange extend around only a portion of the lowermost dish plate attached to the mounting plate.

6. A reinforcing element as claimed in claim 1, wherein the peripheral flange contacts only a portion of the inclined peripheral wall of the lowermost dish plate, the portion of the inclined peripheral wall being an area of high stress.

7. A reinforcing element as claimed in claim 1, wherein the peripheral flange is formed as an inverted V-shape.

8. A reinforcing element as claimed in claim 1, wherein the base flange and peripheral flange are made of one-side clad braze sheet.

9. A dish plate heat exchanger comprising:

a mounting plate;

a plurality of nested dish plates mounted on the mounting plate, the dish plates having inclined, peripheral, overlapping walls, the mounting plate being positioned underneath the plurality of nested dish plates and extending beyond the outer periphery of the walls of the nested dish plates;

a reinforcing element having an outwardly extending base flange attached to at least a portion of the mounting plate that extends beyond the outer periphery of the walls of the nested dish plates, the base flange being positioned on the mounting plate, proximal to and generally surrounding the plurality of nested dish plates; and the reinforcing element also having a peripheral flange extending generally upwardly from the base flange, the peripheral flange being attached in parallel, overlapping engagement with the inclined peripheral wall of at least the lowermost dish plate attached to the mounting plate, and wherein the reinforcing element having an opening permitting a bottom wall of the lowermost dish plate to directly contact the mounting plate.

10. A dish plate heat exchanger as claimed in claim 9, wherein the base flange has a peripheral configuration adapted to correspond to at least a portion of the mounting plate extending beyond the outer periphery of the walls of the nested dish plates.

11. A dish plate heat exchanger as claimed in claim 9, wherein the peripheral flange contacts a portion of the inclined peripheral wall of at least the lowermost dish plate, the portion of the inclined peripheral wall being an area of high stress.

12. A dish plate heat exchanger as claimed in claim 9, wherein the reinforcing element completely surrounds at least the lowermost dish plate attached to the mounting plate.

13. A dish plate heat exchanger as claimed in claim 9, wherein the reinforcing element extends around only a portion of the lowermost dish plate attached to the mounting plate.

* * * * *